United States Patent [19]

Thompson

[11] Patent Number: 4,512,706

[45] Date of Patent: Apr. 23, 1985

[54] SHEAR DOLLY FOR LONG WALL MINING

[75] Inventor: John P. Thompson, Canonsburg, Pa.

[73] Assignee: Phillips Mine & Mill, Inc., Bridgeville, Pa.

[21] Appl. No.: 476,616

[22] Filed: Mar. 18, 1983

[51] Int. Cl.[3] ..... E21C 29/02

[52] U.S. Cl. ..... 414/373; 105/29 R; 238/123; 410/66

[58] Field of Search ..... 414/373, 467, 498; 299/43; 105/29 R, 26 A; 104/48–50; 410/2, 3, 66, 67; 238/123

[56] References Cited

U.S. PATENT DOCUMENTS

| | | | |
|---|---|---|---|
| 1,392,835 | 10/1921 | Levin . | |
| 1,692,260 | 11/1928 | Holmes . | |
| 1,794,083 | 2/1931 | Lund . | |
| 1,862,938 | 6/1932 | Nast . | |
| 2,329,477 | 9/1943 | Miller et al. . | |
| 3,081,716 | 3/1963 | Szczepanik . | |
| 3,855,935 | 12/1974 | Busam | 104/48 |
| 4,240,665 | 12/1980 | Hubbard . | |
| 4,326,753 | 4/1982 | Rynik | 105/29 R X |

*Primary Examiner*—Robert G. Sheridan

*Attorney, Agent, or Firm*—Parmelee, Miller, Welsh & Kratz

[57] ABSTRACT

In the long wall mining of coal, a sectional pan-line is positioned along the working face of the coal seam parallel with the working face. The pan-line sections joined together have parallel rails along which the mining machine travels. At least one of said rails comprises a continuous gear rack at a height above ground with which a power driven gear wheel on the mining machine meshes for propelling the machine back and forth along the face of the coal. This invention is for a wheeled flat bed dolly having two parallel rails, one along each side, that are of height and width matching the rails of the pan-line. There is a support at one end of each of these rails to which the ends of the rails of the pan-line interfit with a temporary connection holding the dolly and pan-line against separation. That rail on the dolly that joins with the gear rack of the pan-line also comprises a gear rack conforming to and matching gear rack on the pan-line, the arrangement enabling the mining machine moving from the pan-line onto the dolly or from the dolly onto the pan-line under its own power. This dispenses with the hours of labor and hazardous work presently required to effect this transition.

5 Claims, 6 Drawing Figures

SHEAR DOLLY FOR LONG WALL MINING

BACKGROUND

This invention is for use in mining operations, particularly the mining of coal, by the method known as "long wall mining," where a heavy, cumbersome cutting machine must be moved under the ground from one location to another.

In long wall mining of coal, the coal is removed from a side face or wall of a long underground corridor which usually extends laterally from the mine entry. The coal is cut or sheared in successive passes from top to bottom along one side face or wall of the corridor by a machine known in the art as a "shear". The shear cuts the coal in a plane parallel with the face of the wall as it moves along a track on the floor of the mine parallel with the face of the coal. The track is known as the pan-line, and as the coal is cut, it falls onto a conveyor belt which carries it to an unloading terminal, usually in the mine entry. The pan line comprises a track with parallel rails, the track being in relatively short sections for easy assembly and removal and having interfitting end sections. At least one rail in each section, usually the one which is the closer to the face of the coal, comprises a specially formed rack bar on which the wheels of the shear roll, and which also has along its length sprocket-like teeth which a sprocket-like driver wheel on the shear engages to effect travel of the machine along the pan line, shearing the coal from the surface of the wall as it travels. Typically, the shear has two large cutting disks which are power driven that cut with a kind of slicing action overlapping swaths of coal from the mine face, one swath above the other. At the end of the pan-line the machine reverses and travels in the opposite direction, again cutting the face of the coal as it moves in the reverse direction.

Not all shears are alike. Some may have the rack rail, which is the nearer to the working face, much higher than the opposite second rail, known as the "trapping shoe rail," against which a shoe on the shear, which braces the shear to keep it vertical and resist the thrust of cutting, may travel. Instead of a shoe, a rigid frame structure of the shear, with a wheel or wheels, may be provided. Still other machines, as here shown, may have a rack rail along each side of the pan line.

As mining operations progress, the shear may have to be transported to a location outside the mine and returned or transferred directly within the mine from one place to another. To accomplish any such move, a crew of workmen is required to transfer the heavy shear from the pan-line onto a flatbed dolly to be then moved from one place to another. Loading and unloading the shear are not only laborious and time-consuming operations, often taking a crew a full shift; but they present danger of serious injury to workmen.

BRIEF DESCRIPTION

The present invention provides a wheeled dolly that may be moved on the mine tracks with a locomotive; or, if provided, with rubber-tired wheels, it may be moved over the mine floor to a terminal of the pan-line, then temporarily secured to that end of the pan-line and the shear then moved under its own power onto the pan-line. In like manner, the shear may be moved off the pan-line onto the dolly for transport to a different location. Either operation may be effected in a matter of minutes with little labor or danger to workmen. This is accomplished by providing the dolly with a rack bar (or rack bars) that temporarily connects with the rack bar at the end of the pan-line. The rack bar or bars so provided on the dolly have sprocket-like teeth corresponding to those on the pan-line. This shear then moves under its own power onto or off the dolly as if it were merely moving from one pan-line rack section to the next.

BRIEF DESCRIPTION OF THE DRAWINGS

The invention may be more fully understood by reference to the accompanying drawing, in which.

DETAILED DESCRIPTION OF THE DRAWINGS

Figure 1:
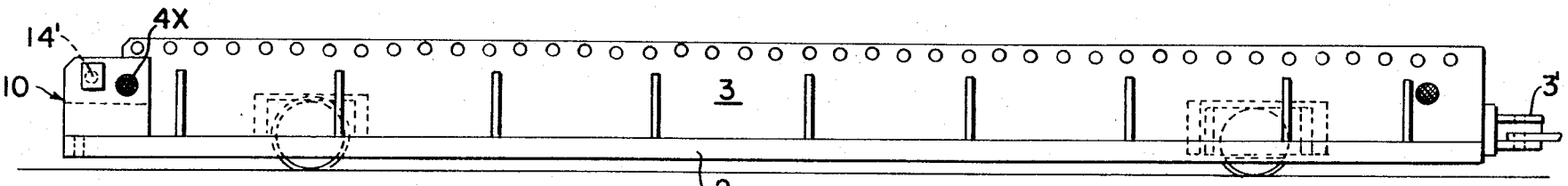
FIG. 1 is a side elevation of a shear dolly embodying my invention.

In the drawing, 2 designates the bed plate of the dolly, this being preferably a single, generally rectangular steel slab, which, for example is here of the order of three inches (32 mm) in thickness. There is a side wall 3 along the greater portion of the length of the slab, comprising a solid slab of steel which reinforces the bed to prevent bending of the bed plate under the massive load of the coal shear when it is supported on the trolley. In the embodiment of the dolly here shown, this side wall is alike on each side of the bed plate and like reference numerals indicate like parts on both. It may be desirable in some instances to have a different wall along one side than the other because of the construction of the shear. There is an inwardly turned flange 4 along the top of the side wall to the inner edge of which is welded a solid section 5. This, in effect, forms a somewhat inverted "L" type section bolted or welded to the bed plate, further strengthening the bed plate when the full weight of the shear is being transported on the dolly from one place to another, and which is braced along the full length of the unit by gussets 6 at spaced intervals along each side. With the L section bolted to the bed, the side walls of the dolly may be interchanged with others which are either higher or lower to match the height of the pan lines with which they are used.

Extending along and secured to the bed plate 2 at the center is a further reinforcement, here shown as an inverted channel section 7 but which may be different in size and shape, depending on the clearance which the shear requires above the bed. It is herein referred to as the "backbone" of the dolly. There are wheel wells 8 through the bed to accommodate wheels 8', each on its own stud axle, at one end of the bed, FIG. 2 of the drawings showing part of the rack 4 broken away to better disclose the wheel wells and wheels. At the other end, the wheels are on an articulated frame 9 that pivots about a longitudinally extending shaft 9'. This provides, in effect, a three-point support for the shear when it is being transported on the dolly to accommodate for uneven mine floor conditions or curved track and is essentially a structure heretofore used on dollies for transporting heavy loads. At the rear or right end of the dolly as shown in FIGS. 1 and 2 is the usual structure 3' for attachment of a tow bar for either pulling or pushing the dolly with a mine locomotive.

The in-turned channel structures 4 and 5 along the top of each side wall are duplicates of the sectional rack bars used in the pan-line of a long wall mine and their elevation above the floor level of the mine matches, or may be designed to match, the height of the pan-line rack. The side walls 3 and 6 of the dolly each terminate a short distance to the rear of the front or left edge of the bed of the dolly, as clearly seen in the "upper" one of the two tracks as viewed in FIG. 2.

Figure 2:
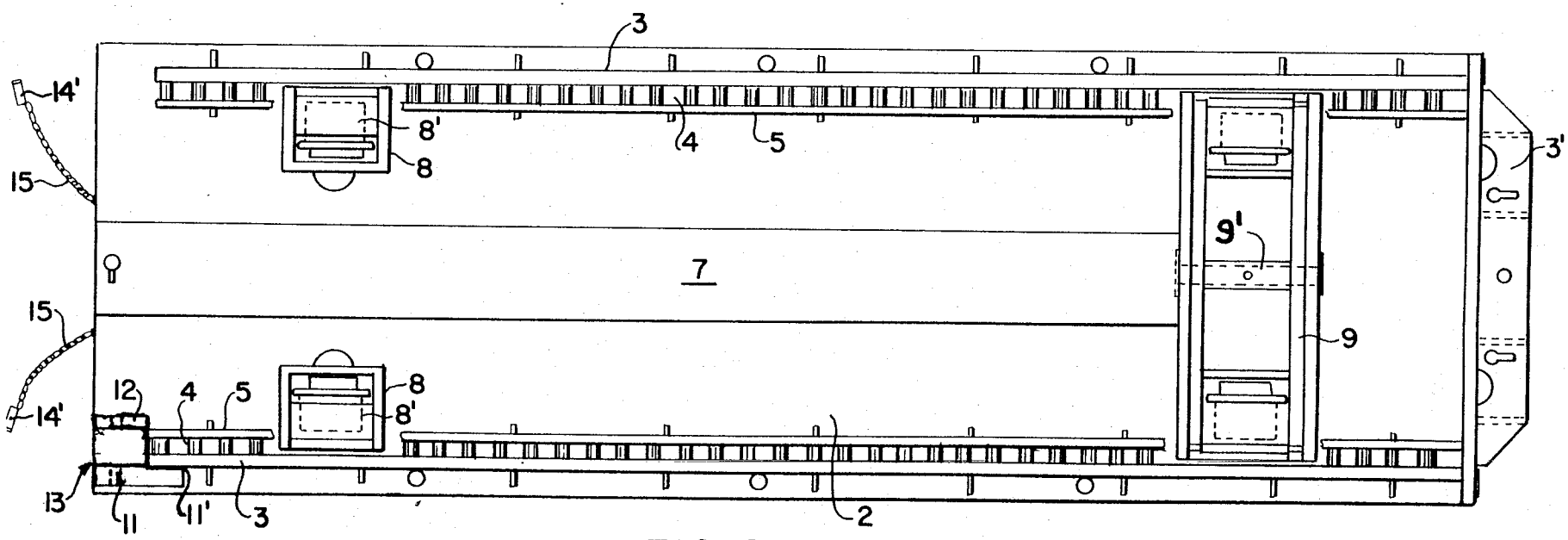
FIG. 2 is a plan view of the shear dolly shown in FIG. 1.
Figure 3:
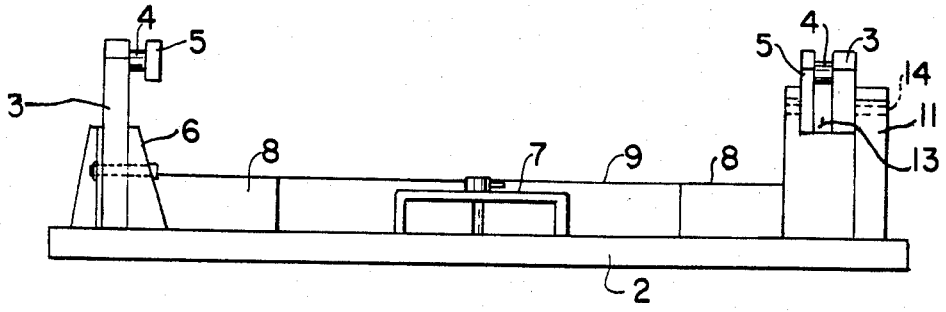
FIG. 3 is an end view of the shear dolly shown in FIG. 2 but with the terminal block removed from the end of one side wall.
Figure 4:
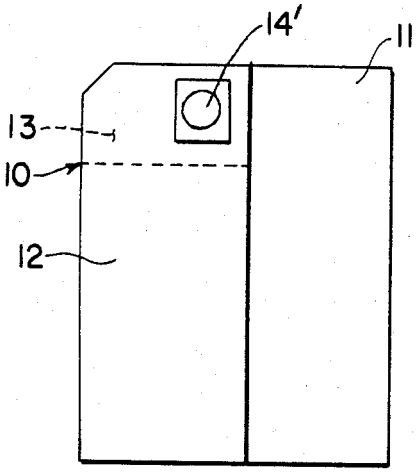
FIG. 4 is a fragmentary side view on a larger scale of the rack bar terminal portion only of FIG. 1.
Figure 5:
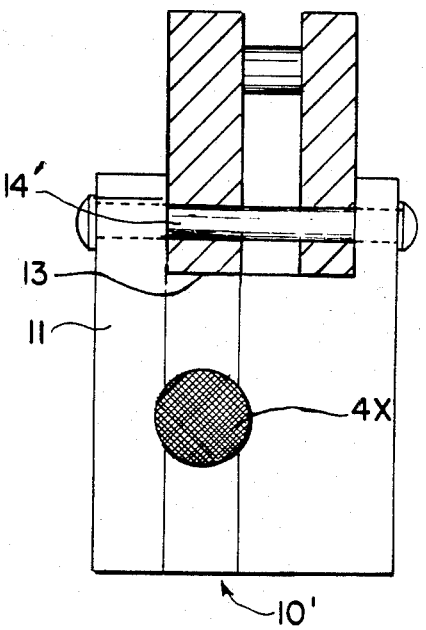
FIG. 5 is a front view of the rack bar terminal of the shear with the pan-line rack bar terminal indicated in section.
Figure 6:
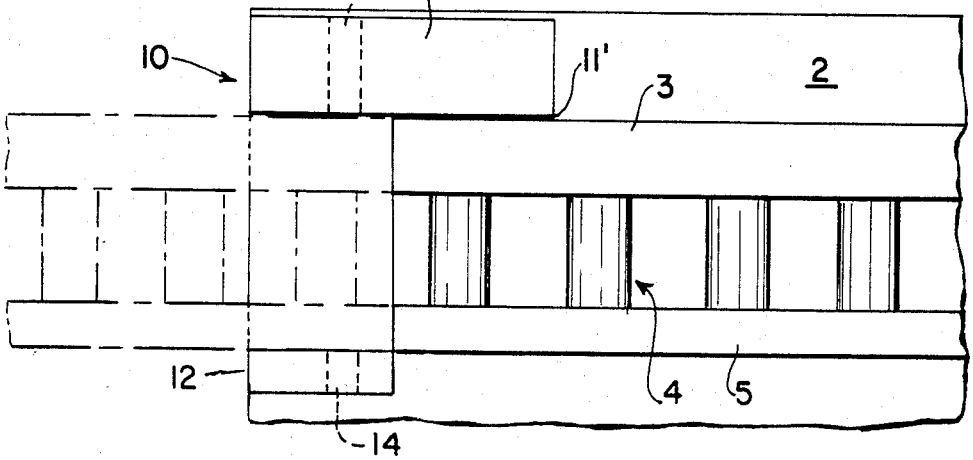
FIG. 6 is also a fragmentary plan view on a larger scale of the rack bar terminal on the dolly and the pan-line terminal in dotted lines.

Referring particularly to FIGS. 4, 5 and 6 and the lower track as viewed in FIG. 2, there is a metal block or column 10 having an outer wide side wall or flange 11. When the block, set vertically, is placed against the end of the side wall 3, the flange 11 laps past the exterior of the side wall 3 and is welded to it, as seen at 11' in FIGS. 2 and 6. The block is of less height than the side wall and in its top, there is a channel-like mortise 13 between portions 12 of the block, and between flanges 11 and 12 there is a channel or mortise 13. This channel is designed to receive the end pan-line rack bar, indicated in dotted lines in FIG. 6 in the drawing. The mortise 13 so formed, is of a depth less than the vertical dimension of the rack bar so that when the rack bar of the pan-line is received in the channel at the top of the block, its gear-toothed top will be clear of the ends of portions 12 forming the sides of the mortise in the block, but deep enough so that a pin 14' may be passed through registering holes at 14 in the extensions 11 and 12 and the registering hole in the terminal of the rack bar. The top of the rack bar on the dolly then is level with and forms in effect, an extension of the pan-line rack bar with no interruption of the continuity of the gear teeth or their spacing, the connection being in effect, a mortise and tenon-type of connection with the end of the pan-line forming the tenon. A similar interfitting connecting block, is provided at the end of the rack bar when, as shown, a rack bar is provided, along the opposite side of the dolly. Shaded disks 4x merely indicate colored reflectors.

With the pan-line and dolly thus connected, the drive wheels of the shear will serve to move the shear onto or off from the dolly under its own power and the interfitting parts of the pan-line and dolly rack, connected by removable pins keeps the dolly from separating from the pan-line under the thrust of the drive wheels of the shear and maintains the correct, spaced continuity of the gear teeth.

While I have shown a rack bar along each side of the dolly, usually there will be a rack bar along one side only and the opposite side need provide only a thrust rail along which a shoe or other thrust member on the shear will move to give support to the shear and help hold it parallel with the face of the coal as is commonly the practice with pan-line sections. In such cases, however, there will be a similar block-like member 10' to form a separable interfitting of parts at the end of the rail with registering holes in the interfitting parts to receive the removable pins.

For convenience two "captive pins" 14' for this purpose are shown, each provided with a link chain 15 the free ends of which are welded to the deck of the dolly as shown in FIG. 1.

The invention provides a definite contribution to safety in the mining of soft-coal in particular and avoids the need to assemble a work crew everytime a shear must be moved.

I have particularly described a dolly for movement along rails in a mine, but the invention may be adapted to mine dollies with rubber-tired wheels. In such cases the rack bar or bars on the dolly join with the rack bars on the pan-line in the same way as they do in the dolly herein described.

What is claimed is:

1. For use in long wall mining operations, a dolly for moving a shear from place to place comprising:

a wheeled platform with a parallel rail extending along each side thereof defining a longitudinal axis between said parallel rails on which the shear may travel onto and off from the dolly out from and onto a pan-line in the mine, the wheeled platform adapted to travel along a path which is generally parallel to the longitudinal axis of said parallel rails carried thereon;

a rack bar ridgedly supported on and extending along at least one side of the platform and comprising one of said two parallel rails, one end of the rack bar on the wheeled platform being formed to provide an interfitting connection with a rack bar section at the end of the rack bar forming a part of the pan-line in the mine, said connection when the rack on the platform and the pan-line rack section are interfitted then forms a continuous toothed rack for engagement with a meshing drive gear on the shear, the other of the two rails on the platform also having an interfitting connection with a second rail of the pan-line.

2. The dolly defined in claim 1 in which there is mortise and tenon type of connection between each of the two parallel rails on the platform with the rails of the pan-line terminal section.

3. The dolly defined in claim 2 in which the mortise is provided by a fixed member at the ends of the parallel rails on the platform and interfitting tenons are on the terminal section of the pan-line and have a vertical dimension deeper than the mortise and the top of the pan-line may extend above and be clear of the mortise and flush with the top of the rails on the dolly.

4. The dolly defined in claim 1 in which the rack bar is removably bolted to the platform for replacement with a rack of a different height.

5. The dolly defined in claim 1 in which the platform is an integral metal plate and there is secured to the upper surface of the plate a rigid flanged metal section extending throughout the major portion of the length of the plate between the parallel rails of a shape and height to clear the underside of the shear when it is positioned on the rails providing a backbone to reinforce the plate against bending under the weight of the shear.

* * * * *